US006953330B1

(12) United States Patent
Muto

(10) Patent No.: US 6,953,330 B1
(45) Date of Patent: Oct. 11, 2005

(54) SCROLL VACUUM PUMP

(75) Inventor: Ryusuke Muto, Yokohama (JP)

(73) Assignee: Anest Iwata Corporation, (JP)

( * ) Notice: Subject to any disclaimer, the term of this patent is extended or adjusted under 35 U.S.C. 154(b) by 0 days.

(21) Appl. No.: 10/909,765

(22) Filed: Aug. 2, 2004

(51) Int. Cl.[7] ..... F03C 2/00; F04C 18/02

(52) U.S. Cl. ..... 418/60; 418/94; 418/101; 418/55.1; 418/55.6; 184/6.18

(58) Field of Search ..... 418/60, 94, 83, 418/87, 99, 101, 55.6, 55.1, 270; 408/DIG. 1

(56) References Cited

U.S. PATENT DOCUMENTS

| | | | | | |
|---|---|---|---|---|---|
| 5,160,253 | A | * | 11/1992 | Okada et al. | 418/55.6 |
| 5,743,719 | A | | 4/1998 | Haga et al. | |
| 5,842,843 | A | * | 12/1998 | Haga | 418/94 |
| 6,109,897 | A | * | 8/2000 | Haga | 418/60 |
| 6,398,515 | B1 | * | 6/2002 | Yokomachi et al. | 417/201 |

FOREIGN PATENT DOCUMENTS

| | | | | | |
|---|---|---|---|---|---|
| JP | 61192881 | A | * | 8/1986 | F04C 18/02 |
| JP | 63-105294 | | | 5/1988 | |
| JP | 02049989 | A | * | 2/1990 | F04C 18/02 |
| JP | 02049990 | A | * | 2/1990 | F04C 18/02 |
| JP | 03237287 | A | * | 10/1991 | F04C 18/02 |
| JP | 2001-304148 | | | 10/2001 | |

* cited by examiner

*Primary Examiner*—Theresa Trieu

(57) ABSTRACT

A scroll vacuum pump has an orbiting scroll and fixed scrolls. The orbiting scroll is rotatably mounted to an eccentric portion of a driving shaft and revolved by the driving shaft, so that a gas is sucked into a compression chamber between the orbiting scroll and fixed scrolls through a sucking bore. External air is introduced through a ventilating hole axially formed in the driving shaft and into the compression chamber via a check valve that opens by centrifugal force when the driving shaft rotates, thereby cooling the eccentric portion and bearings to increase durability thereof. When the driving shaft stops, the check valve closes, so that a toxic gas in the compression chamber is not leaked to the outside to prevent environment pollution.

2 Claims, 2 Drawing Sheets

SCROLL VACUUM PUMP

BACKGROUND OF THE INVENTION

The present invention relates to a scroll vacuum pump and especially to a scroll vacuum pump in which a fixed wrap of a fixed scroll is engaged with an orbiting wrap of an orbiting scroll rotatably mounted to an eccentric portion of a driving shaft in a housing, the orbiting scroll being revolved at a certain eccentricity by the driving shaft so that a gas sucked through the outer circumference of the housing is compressed towards the center and discharged.

The scroll vacuum pump is known. In the scroll vacuum pump, operation time is too long, and the temperatures of the eccentric portion of the driving shaft and bearing and packing for supporting it are raised to cause the bearing and packing to be damaged, so that they become difficult to be used.

Thus, in the scroll vacuum pump, to increase durability, it is essential not to become excessive high temperature on the eccentric portion of the driving shaft even when operation time is too long.

To comply with the demand, the following measures are known among persons skilled in the art:

(1) Low-temperature or room-temperature air or nitrogen is introduced into a compressing region of the scroll vacuum pump and cools the region while diluting a toxic gas in the compressing region.

(2) A ventilating hole formed axially in the driving shaft allows low-temperature or room-temperature air or nitrogen to be discharged onto the bearing and to be introduced into the compressing region. After cooling to the region it is discharged.

(3) The eccentric portion of the driving shaft is hollow and low-temperature or room-temperature air is introduced into the eccentric portion to cool it.

JP 63-105294A discloses that an inert gas such as $N_2$ is introduced from the outside as the above (1) and that FIG. 5 thereof illustrates the gas flowing path in the eccentric portion of the driving shaft as the above (3).

However, there are problems in the technical measures. To introduce a low-temperature or room-temperature air or nitrogen into the compressing region, it is necessary for an introducing path to be provided therein and for means for supplying the gas to be provided outside. So its structure becomes complicate and larger to increase cost.

When the driving shaft rotates, the low-temperature or room-temperature air or nitrogen is introduced through the ventilating hole of the driving shaft to cool the bearings, but when the driving shaft stops, a toxic gas or impurity-including gas in the compressing region runs back and is discharged to the outside via the ventilating hole to cause environmental pollution.

SUMMARY OF THE INVENTION

In view of the disadvantages in the prior art, it is an object of the invention to provide a scroll vacuum pump in which external air is introduced into a compression chamber between an orbiting scroll and fixed scrolls to cool bearings to increase durability during operation while a toxic gas in the compression chamber is not leaked to the outside when it is not operated.

BRIEF DESCRIPTION OF THE DRAWINGS

The features and advantages of the invention will become more apparent from the following description with respect to an embodiment as shown in appended drawings wherein.

DETAILED DESCRIPTION OF THE PREFERRED EMBODIMENT

Figure 1:
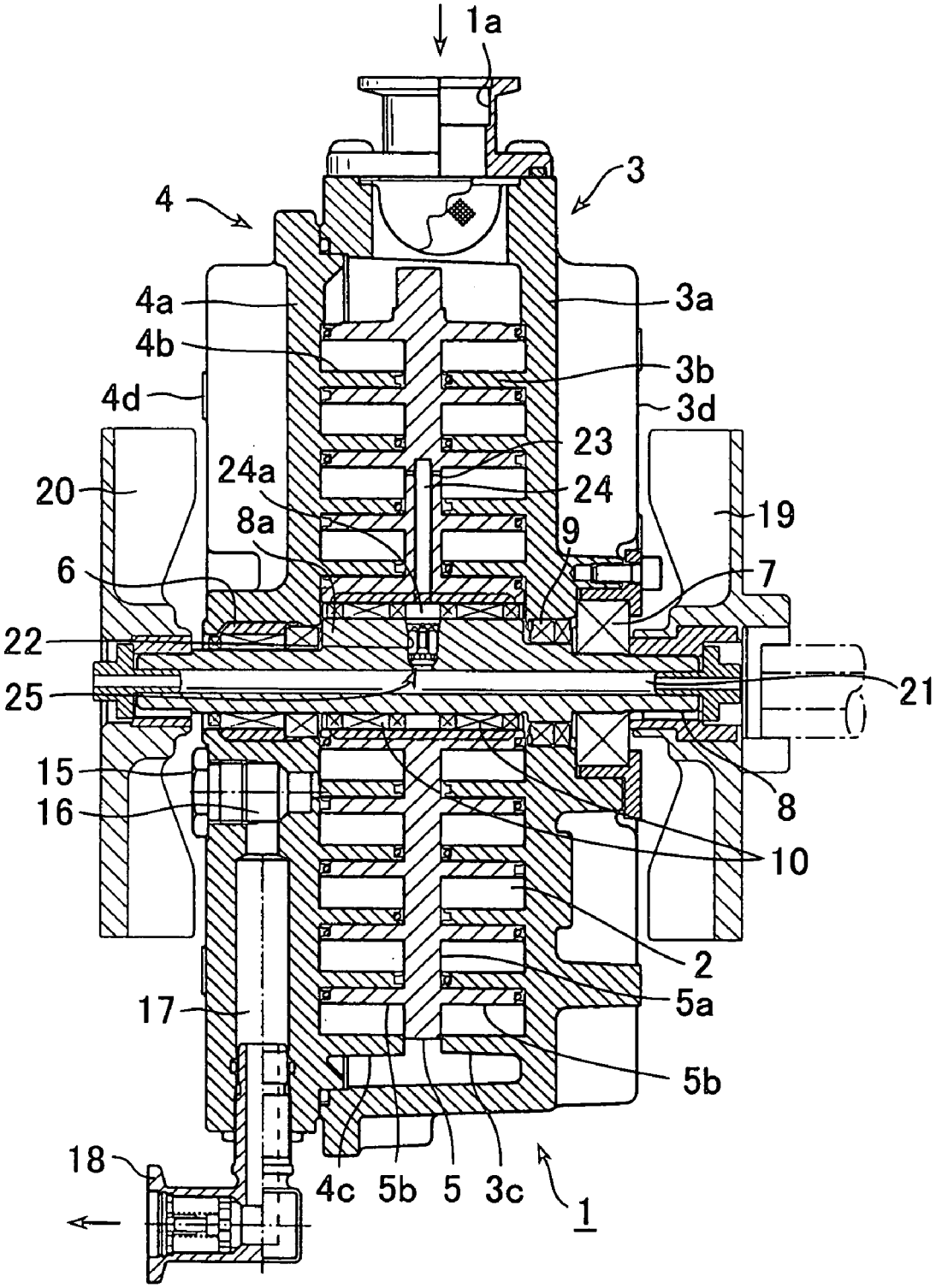
FIG. 1 is a vertical sectional side view of one embodiment of a scroll vacuum pump according to the present invention.

FIG. 1 is a vertical sectional side view of a scroll vacuum pump of the present invention in which an orbiting scroll is revolved to forward a gas sucked through the outer circumference to a compressing region formed between the orbiting scroll and a fixed scroll, the gas being discharged close to the center after compressed.

Numeral 1 denotes a housing which has a sealed disc-like compression chamber 2, and comprises a casing 3 and a cover 4 with a sucking bore 1*a* on its circumference. The casing 3 and the cover 4 have fixed end plate 3*a* and 4*a* that surround the compression chamber 2. The fixed end plates 3*a* and 4*a* have spiral fixed wraps 3*b* and 4*b* respectively to form fixed scrolls 3*c* and 4*c*.

In the compression chamber 2 between the fixed end plates 3*a* and 4*a*, an orbiting scroll 5 is revolved around an axis of the compression chamber 2. The orbiting scroll 5 has orbiting wraps 5*b*,5*b* engaged with the fixed scrolls 3*c*,4*c* deviating by 180 degrees, and is rotatably mounted to an eccentric portion 8*a* of a driving shaft 8 with bearings 6,7 at the center of the housing 1.

The orbiting end plate 5*a* is connected to the fixed end plate 3*a* with a three known pin-crank-type self-rotation-preventing mechanisms (not shown in FIG. 1). When the driving shaft 8 rotates, the orbiting plate 5*a* eccentrically revolves in the compression chamber 2 thereby changing the size of a sealed space between the fixed wraps 3*b*,4*b* and the orbiting wrap 5*b* engaged with each other.

Figure 2:
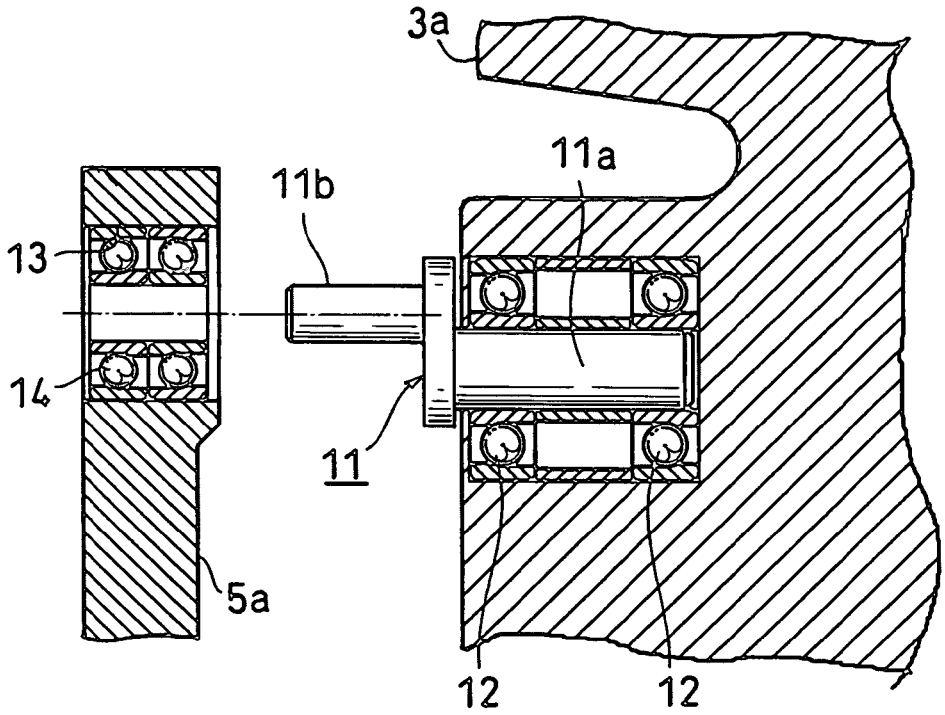
FIG. 2 is an exploded vertical sectional view of a pin-crank-type self-rotation-preventing mechanism.

As shown in FIG. 2, in the pin-crank-type self-rotation-preventing mechanism, a main shaft 11*a* of a pin-crank 11 is rotatably fitted in the fixed end plate 3*a* with a ball bearing 12, and a crank shaft 11*b* is fitted in a support bore 13 with a bearing 14 closer to the outer circumference of the orbiting plate 5*a*.

There is formed a through-bore 16 which communicates with the compression chamber 2 and is closed at the outer end by a plugue 15 close to the center of the casing 4. A discharge bore 17 radially extends from the through bore 16 to the outer circumference of the casing 4. A discharge joint 18 is fitted over the discharge bore 17. The driving shaft 8 is driven by a motor (not shown) and cooling fans 19,20 are mounted to the driving shaft 8 closer to the outer ends of the casing 3 and the cover 4 respectively. Cooling fins 3*d*,4*d* are projected on the outer surfaces of the casing 3 and the cover 4 respectively.

According to the present invention, an ventilating hole 21 which communicates with external air at one end extends along the center of the driving shaft 8 and communicates with a valve bore 22 in the middle of the thickened eccentric portion 8*a* of the driving shaft 8. The valve bore 22 extends radially from the ventilating hole 21 to the outer circumferential surface of the eccentric portion 8*a*.

The orbiting end plate 5*a* has a discharge bore 24 which extends from the outer end of the ventilating hole 21 via a communicating path 24*a* radially and opens via a smaller-diameter outlet 23 to a low-pressure area in the middle of the radius of the compression chamber 2 formed between the fixed wraps 3*b*,4*b* and the orbiting wrap 5*b*.

In the valve bore 22, there is a check valve 25 which opens outward radially, but does not open inward.

Figure 3:
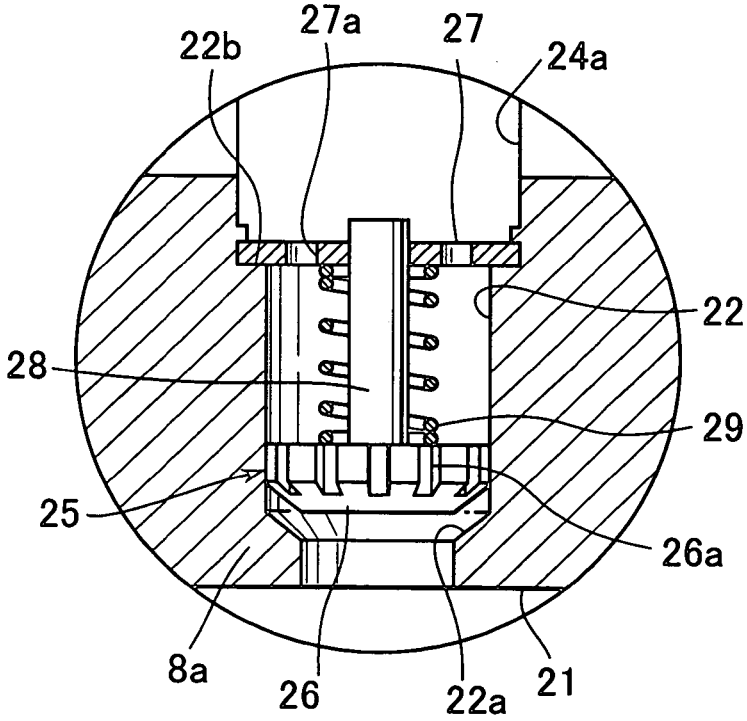
FIG. 3 is an enlarged vertical sectional view of a check valve.

The check valve 25 is shown in FIG. 3.

A smaller-diameter valve seat 22*a* is formed at the inner end radially of the valve bore 22, and a larger-diameter portion 22*b* is formed at the outer end. A valve disc 26 has a tapered portion at the lower end and a cylindrical portion which has a plurality of vertical grooves 26*a* on the outer circumferential surface. The tapered portion of the valve disc 26 is fitted on the valve seat 22*a* when the valve bore 22 is closed by the check valve 25. A support plate 27 which has a discharge opening 27*a* is provided on the larger-diameter portion 22*b*.

A valve shaft 28 extends vertically from the center of the valve disc 26 into the support plate 27, and the valve shaft 28 is surrounded by a compression spring 29 between the valve disc 26 and the support plate 27.

In the scroll vacuum pump, while strength of the compression spring 29 of the check valve 25 is determined to achieve the object described later, the sucking bore 1*a* is connected to a sealed container (not shown) to be depressurized or evacuated when the valve disc 26 is closed. The sealed container contains a toxic gas such as HCl. The driving shaft 8 is driven while the ventilating hole 21 of the driving shaft 3 communicates with external air.

With rotation of the driving shaft 8, the orbiting scroll 5 pivotally mounted thereto is revolved at a certain eccentricity while it is engaged with the fixed scrolls 3*c*,4*c*. Accordingly, the sealed container connected to the sucking bore 1*a* is gradually depressurized and evacuated, so that the toxic gas is sucked into the compression chamber 2 in the scroll vacuum pump.

When the rotation speed of the driving shaft 8 exceeds a certain value, the valve disc 26 of the check valve 25 is subjected to centrifugal force produced thereby, and moved radially against the compression spring 29 to open.

Meanwhile, the compression chamber 2 in the scroll vacuum pump is compressed, but has always lower pressure than atmospheric pressure.

When the valve disc 26 is allowed by the centrifugal force to move away from the valve seat 22*a*, air introduced from the outside into the valve bore 22 via the ventilating hole 21 flows into the discharge bore 24 through the grooves 26*a* of the valve disc 26 and the opening 27*a* of the support plate 27. Finally the air is sucked into the compression chamber between the fixed and orbiting scrolls 3*c*,4*c*,5 through the outlets 23.

Hence the eccentric portion 8*a* of the driving shaft 8, and the bearings 9,10 and packing around it are cooled by the air introduced from the outside through the outlets 23, thereby increasing durability.

When operation stops, the check valve 25 is automatically closed thereby preventing the toxic gas in the compression chamber 2 from being discharged to the outside. So environment is not contaminated by the toxic gas.

The fixed and orbiting scrolls in the embodiments have two-sides, but the present invention may be also applied to a one-side scroll.

The foregoing merely relates to embodiments of the invention. Various changes and modifications may be made by a person skilled in the art without departing from the scope of claims wherein:

What is claimed is:

1. A scroll vacuum pump comprising:

a housing;

a driving shaft along a center of the housing, said driving shaft having an eccentric portion, a fixed scroll fixed in the housing, said fixed scroll having a fixed wrap; and an orbiting scroll rotatably mounted around the eccentric portion of the driving shaft and having an orbiting wrap, the orbiting scroll being revolved eccentrically by the driving shaft so that a gas sucked through an outer circumference of the housing is compressed toward the center of the housing in a compression chamber between the fixed and orbiting wraps engaged with each other and discharged, thereby sucking a gas into the compression chamber, said driving shaft having a ventilating hole that communicates with outside and extends axially therein, a valve bore that radially extends communicating with the ventilating hole at one end and opening to the compression chamber at the other end, said valve bore having a check valve that opens by centrifugal force when the driving shaft rotates thereby introducing external air into the compression chamber for cooling, while the check valve closes when the driving shaft stops thereby preventing the gas from being leaked from the compression chamber to the outside.

2. A scroll vacuum pump as claimed in claim 1 wherein the orbiting scroll has a discharge bore from the valve bore to outlets that open to the compression chamber.

* * * * *